US006283196B1

(12) United States Patent
Jacobsen et al.

(10) Patent No.: US 6,283,196 B1
(45) Date of Patent: Sep. 4, 2001

(54) METHOD, PRESSURE-SUPPLY MEMBER AND PRESSURE-SUPPLY SYSTEM FOR ACTIVE AFTER-FEEDING OF CASTINGS

(75) Inventors: Ole Anders Jacobsen, Tisvildeleje; Peter Møller Iversen, Brønshøj; Uffe Andersen, Skævinge, all of (DK)

(73) Assignee: Georg Fischer Disa A/S (DK)

( * ) Notice: Subject to any disclaimer, the term of this patent is extended or adjusted under 35 U.S.C. 154(b) by 0 days.

(21) Appl. No.: 09/380,754

(22) PCT Filed: Mar. 18, 1998

(86) PCT No.: PCT/DK98/00102

§ 371 Date: Sep. 13, 1999

§ 102(e) Date: Sep. 13, 1999

(87) PCT Pub. No.: WO98/41341

PCT Pub. Date: Sep. 24, 1998

(30) Foreign Application Priority Data

Mar. 18, 1997 (DK) ..... 0303/97

(51) Int. Cl.[7] ..... B22D 18/02
(52) U.S. Cl. ..... 164/120; 164/259; 164/285
(58) Field of Search ..... 164/120, 285, 164/359, 360, 66.1, 259

(56) References Cited

U.S. PATENT DOCUMENTS

| | | | | |
|---|---|---|---|---|
| 2,568,428 | * | 9/1951 | Billiar | 22/134 |
| 3,566,952 | * | 3/1971 | Lane | 164/120 |
| 5,636,680 | * | 6/1997 | Mogensen et al. | 164/66.1 |
| 5,954,113 | * | 9/1999 | Buchborn | 164/61 |

FOREIGN PATENT DOCUMENTS

WO 95/18689 * 7/1995 (WO) .

* cited by examiner

*Primary Examiner*—Tom Dunn
*Assistant Examiner*—Len Tran
(74) *Attorney, Agent, or Firm*—Larson & Taylor, PLC

(57) ABSTRACT

When pouring casting cavities in casting moulds having after-feeding reservoirs, tubular lances are introduced, firstly with their point at a short distance from the after-feeding reservoir, after which the lances are pressurized from a pressure chamber and by means of a member with an inclined surface pressed downwardly through the last short distance to the after-feeding reservoir so as to pressurize the latter. With this arrangement it is possible to pressurize the after-feeding reservoirs without the need of equipping the casting moulds with complicated extra equipment and without risk of the molten metal being pressurized unnecessarily.

19 Claims, 4 Drawing Sheets

METHOD, PRESSURE-SUPPLY MEMBER AND PRESSURE-SUPPLY SYSTEM FOR ACTIVE AFTER-FEEDING OF CASTINGS

TECHNICAL FIELD

The present invention relates to a method for active after-feeding of castings with a pressure.

BACKGROUND ART

It is commonly known that metals, both in the liquid and solid state, when cooled undergo a decrease in volume, a so-called thermal contraction. In moulds, in which there is a non-uniform distribution of heat quantity in the mould cavity after the pouring, and in which for this reason not all the parts of the castings solidify at the same time, this causes the region of the casting solidifying last to give off liquid metal to compensate for the contraction in the regions of the casting having solidified earlier, this leading to flaws in the casting commonly called "shrinkages", appearing either as depressions in the surface of the casting or as hollows (cavities or micro-shrinkages) within the casting. In order to avoid these faults, the skilled person can take a series of steps, of which the most common is the use of after-feeding reservoirs, i.e. cavities in the mould being filled with metal during the pouring operation and having such dimensions that the metal in them solidifies later than the last-solidifying regions of the casting, being connected to these regions through ducts with a relatively large cross-sectional area so as to enable them to after-feed these regions with liquid metal during the solidification of the casting.

Such after-feeding reservoirs are mainly known in two types, viz. as feeders or risers, i.e. substantially cylindrical cavities extending from the duct connecting them to the casting to the upper surface of the mould, and as internal or enclosed cavities in the mould, so-called "suction buds", placed in the immediate vicinity of the region of the casting to be fed.

Relative to the latter type, the former type exhibits the advantage that the higher metallostatic pressure at the after-feeding location, i.e. the pressure of the overlying metal column, to a high degree supports the after-feeding by pressing the feeding metal to the connecting duct into the casting, while in the latter type, the pressure diminishes during the after-feeding process.

On the other hand, the latter type exhibits the advantage of normally giving a higher metal yield in the casting process, i.e. a lesser quantity of metal to be separated from the castings for subsequent re-melting (recycling), this also reducing the energy consumed for melting.

Compared to moulds with a horizontal parting surface, the top surface of moulds with a vertical parting surface has a relatively small surface area, and for this reason, the latter type of moulds allows only to a low degree the use of feeders or risers for after-feeding purposes, and thus, for this purpose it is generally necessary to use the above-mentioned "suctions buds" with the associated disadvantage mentioned above, i.e. the relatively lower metallostatic pressure for pressing the after-feeding metal in through the duct to the casting. This disadvantage is even more noticeable when after-feeding light-metal castings, i.e. castings of aluminium and its alloys or magnesium and its alloys, due to the relatively low specific weight of these metals.

Casting of light-metal castings in moulds with vertical parting surfaces is of commercial interest especially in two cases, viz. by casting in permanent moulds, e.g. pressure die-casting, and by casting in moulds in a string-moulding plant, such as DISAMATIC®, a string-mould-making plant manufactured and marketed by the Applicants. With such light-metal alloys it occurs frequently that the ingate system and especially the after-feeding reservoir after the solidification constitute roughly one-half of the weight of the casting, requiring separation from the casting proper and possibly recirculation, causing extra work and a large energy loss when superfluous material is first melted and then solidifies.

Because of the problems mentioned above, it is known when carrying out casting processes of this kind to reduce the excess cast material from the ingate system and the after-feeding reservoir by applying a pressure, e.g. in the form of a gas pressure, to the after-feeding reservoir in order to press the molten metal into the mould cavity to compensate for the contraction of the parts having solidified. The equipment for such casting processes are known e.g. from PCT application WO 95/18689. There are mainly two types of equipment of this known kind, that is capable of applying pressure to an after-feeding reservoir during movement of the mould.

One of these types is constituted by complicated individual units adapted to be attached to or integrated in the mould and are capable of supplying pressure independently; these units are complicated and costly, and they may even make it difficult to manufacture the moulds.

In contrast, the other type is constituted by coupling elements adapted to be integrated in the moulds during the manufacture of the latter, subsequently being supplied with pressure by means of complicated pressure-transfer equipment that is relatively costly and can complicate the construction of pouring channels or make it necessary to alter the latter.

In practice, this known equipment has functioned satisfactorily and has made it possible to reduce the size of the after-feeding reservoir, thus reducing the energy loss by first melting the material and then remove it from the castings, at the same time as the quality of the castings is the same or even improved, due to the after-feeding reservoir being supplied with pressure all the time during the solidification of the casting.

Even though so far, this equipment has been functioning very well, it does suffer from the disadvantage of consisting of relatively complicated units to be integrated into the moulds, comprising either complicated extra equipment for each mould to apply pressure to the after-feeding reservoir, or complicated pressure-transfer equipment, or else having required a special arrangement and construction of the casting and cooling sections, the latter being costly and possibly setting limits to the construction of the moulds, because they are to be supplied with pressure from the equipment in the casting/cooling section. Thus, already during the work of constructing the moulds, it has been necessary to take into consideration that not only the after-feeding reservoir, but also pressure-transfer elements were to be integrated in the moulds when manufacturing the latter.

DISCLOSURE OF THE INVENTION

Thus, it is the object of the present invention to make it possible in a simple manner to apply a pressure to at least one after-feeding reservoir in the moulds in a manner requiring less consideration of this pressure supply when designing the moulds, due to an increased adaptability of the pressure supply.

This object is achieved with a method of a kind referred to initially, by according to the present invention proceeding in the manner set forth hereinbelow.

By proceeding in this manner, it is possible to introduce the extra equipment in the form of a pressure-supply conduit into the mould at an arbitrary point in time from the making of the mould until pressure is applied to the after-feeding reservoir. When using sand moulds, e.g. in a string-mould plant, this can take place by pushing the pressure-supply conduit into the mould sand, whereas in contrast, permanent moulds have to be provided with a hole connecting the after-feeding reservoir to the outside of the mould, which hole at its lowermost or innermost end being provided with a plug or bung, e.g. in the form of a plug or bung of wood or cement.

By the preferred embodiment set forth below it is achieved that the after-feeding reservoir is closed outwardly until pressure is supplied to it, thus making it possible to pour the molten metal into the mould in the conventional manner without risk of additional oxidation due to the supply of pressure, or that this pressure causes molten metal to be pressed out of the mould.

At a suitable moment in time, preferably before the level of molten metal in the after-feeding reservoir has fallen due to the contraction of the casting, pressure is applied to the pressure-supply conduit and the latter is pushed into the after-feeding reservoir so as to penetrate the barrier in the form of e.g. mould material or a plug or bung. Thus, the pressure-supply conduit cannot come into contact with the molten metal until the time when it supplies a pressure; thus, it is self-cleaning. If, on the contrary, the pressure-supply conduit had been in contact with the molten metal before having pressure applied to it, there would be a risk of the molten metal solidifying about the pressure-supply conduit, thus closing the latter.

The preferred embodiment further set forth below makes it possible in a simple manner to introduce the pressure-supply conduit into the after-feeding reservoir by means of a force and using means externally of the mould.

The preferred embodiment still further set forth below makes it possible to carry out the method when using a mould-string casting plant, pressure being supplied to the pressure-supply conduit from stationary pressure sources via a movable pressure-feed chain. This simplifies the construction of the pressure-supply conduit while at the same time exploiting the advantages of having stationary pressure sources.

A preferred method of providing pressure in the pressure-supply conduit before introducing the latter into the after-feeding reservoir is also disclosed.

During the progressive lowering of the column of molten metal in the after-feeding reservoir it is advantageous to increase the pressure from the pressure-supply conduit in order to compensate for the decreased pressure from the column of molten metal, and this can e.g. be carried out as indicated below, making it possible to supply successively increasing pressures.

An advantageous method of providing the force for pressing the pressure-supply conduit down and/or removing it is further disclosed.

An advantageous method, i.e. reducing the force on the pressure-supply conduit when pressure is applied to it when connecting it to a pressure chamber is still further disclosed.

Further, the present invention relates to a pressure-supply member, said member being characterized by the features set forth hereinbelow, according to the invention making it possible to provide a particularly simple construction of the pressure-supply conduit.

By constructing the pressure-supply member as disclosed, it is possible to avoid that the exit apertures from the pressure-supply member are blocked when penetrating the mould material or said plug or bung into the after-feeding reservoir.

By further shaping a pointed end, it is possible to provide this pointed end in a simple manner.

When the pressure-supply member is additionally provided with a collar, the introduction and removal of the pressure-supply member is facilitated.

By also providing the pressure-supply member with a coating or blackening, it is achieved that the pressure-supply member does not get stuck in the mould material, if e.g. the binding agent in the mould material solidifies or hardens during the presence of the pressure-supply member, or even in the molten metal, if the latter solidifies before the member is removed from it.

Finally, the present invention relates to a pressure-supply system, which by means of the features set forth hereinbelow, makes it possible in a simple manner to provide a supply of pressure to the pressure-supply conduit according to the method of the invention.

Additional advantageous embodiments are set forth hereinbelow.

BRIEF DESCRIPTION OF THE DRAWINGS

In the following detailed part of the present description, the invention will be explained in more detail with reference to the exemplary embodiments shown on the drawing, on which

DESCRIPTION OF THE PREFERRED EMBODIMENTS

Figure 1:
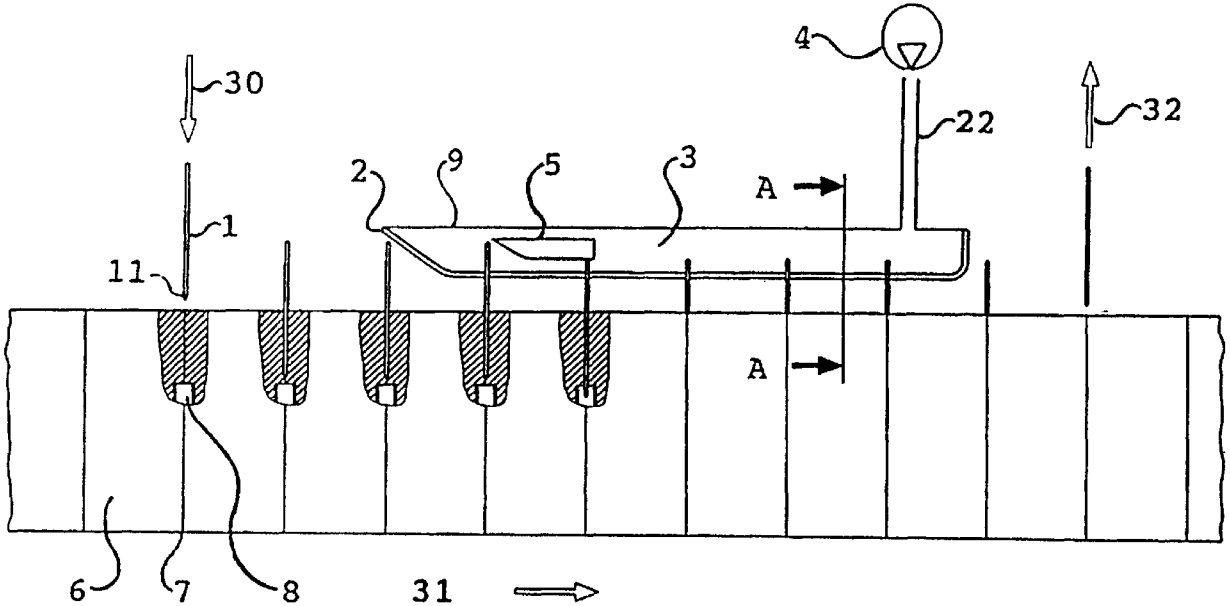
FIG. 1 shows a mould string belonging to a string-moulding plant, in which an after-feeding reservoir in each mould is provided with an after-feeding pressure by means of of pressure-supply system according to the invention.

FIG. 1 shows a mould string consisting of mould parts 6, each of which on each side of a paring surface 7 forming one-half of the respective mould cavities (not visible on the drawing). Associated with the ingate system is an after-feeding reservoir 8, which during the pouring of molten metal into the mould is filled with molten metal that is to flow onwards from the after-feeding reservoir 8 to the mould cavity, commensurately with the contraction of the cast material in the mould cavity. To make it possible for the molten metal from the after-feeding reservoir 8 to flow into and feed contractions in the mould cavity in the mould part 6, it is necessary to apply pressure to the reservoir 8.

The supply of pressure to the after-feeding reservoir 8 takes place by means of a pressure-supply conduit in the form of a lance 1, the latter initially being introduced into the mould part 6 to such an extent that the lance point 11 on the lance 1 is close to the after-feeding reservoir 8 without penetrating the last layer of material or plug just before the after-feeding reservoir 8. This is illustrated by the lance 1 being introduced downwardly into the mould parts 6 in the direction of the arrow 30, the downward movement ceasing before the point penetrates the last layer just before the after-feeding reservoir 8. Then, the lance 1 is advanced together with the mould string in the direction of the arrow 31 towards a pressure-feeding chain or a pressure-supply system. If, at this moment in time, the moulds are not filled with molten metal, the latter is poured before the arrival at the pressure-supply system.

Figure 2:
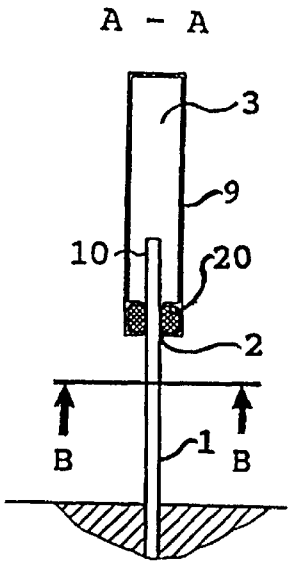
FIG. 2 is a partial sectional view along the section line A—A in FIG. 1, showing the connection between the pressure-chamber and the pressure-supply conduit.
Figure 3:
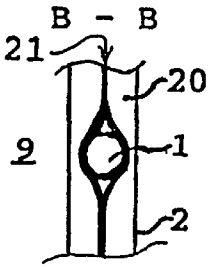
FIG. 3 is a partial sectional view along the line B—B in FIG. 2, showing how the pressure-supply conduit by means of the lips in the slot extends sealingly into the pressure chamber.

The pressure-supply system consists of a pressure source 4 supplying the pressure to a pressure chamber 3 enclosed by a pressure-chamber enclosure 9, cf. also FIGS. 2 and 3, in which is provided a longitudinal slot 2, sealed outwardly by means of lips 20, each from the respective side of the slot being pressed together along a lip parting surface 21, so that the pressure chamber 3 is substantially sealed outwardly. In the pressure chamber 3 there is also a pressing-down element 5 for pressing the lances 1 downwardly when they are under pressure. When the lances 1 reach the pressure-supply system, the lance end with the pressure-supply end 10 lies in abutment with the lips 20 in the slot 2 and separates these lips 20 about their parting surfaces 21, so that the lance end 10 moves into the pressure chamber 3 and communicates with the pressure reigning in the latter. After the lances 1 thus having been made to communicate with the presssure in the pressure chamber 3, they move along with the mould string forwardly towards the pressing-down element 5, in the example shown having a downwardly facing inclined surface, that presses the lance end down, when the lance is advanced with the mould string in the direction of the arrow 31. By this pressing-down of the lance 1, the lance point 11 penetrates the last material layer or plug just before the after-feeding reservoir 8.

In this manner, the after-feeding reservoir 8 is made to communicate pressure-wise with the pressure chamber 3 via the lance 1, so that pressure is applied to the after-feeding reservoir. This pressure is maintained during the advancement of the lance in the direction of the arrow 31 and along the full length of the pressure-supply system, until the lance leaves the latter through the end of the slot 2. The length of this advancement is so adapted, that the molten metal is solidified in the mould cavity in the mould part 6. When the lances 1 together with the mould string have been moved out of the pressure-supply system, the lances 1 are removed from the mould part 6 in the manner illustrated by the arrow 32. This takes place before the mould parts 6 are advanced further along the cooling section to e.g. an extraction station.

Figure 5:
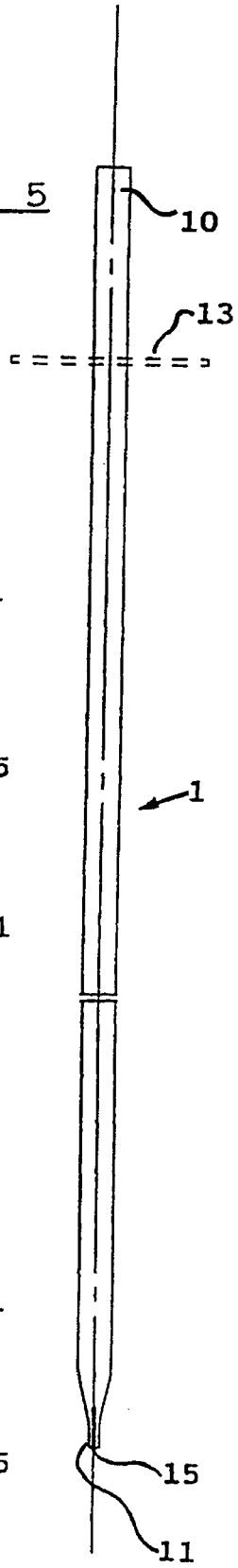
FIG. 5 shows a lance according to the invention as viewed in one plane.
Figure 5B:
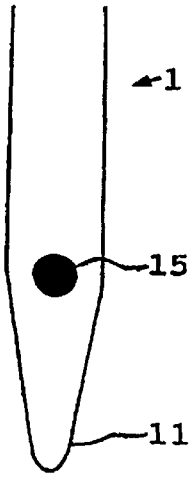
FIGS. 5*a* and 5*b* show different shapes of the pointed end of the lance.
Figure 5A:
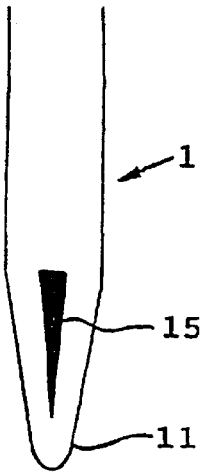
Figure 6:
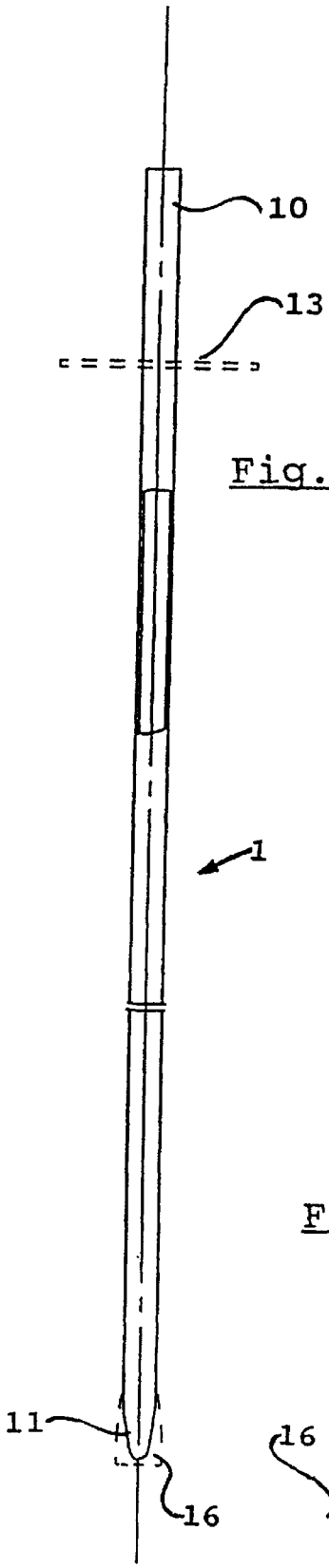
FIG. 6 shows the lance of FIG. 5 turned through 90° about its longitudinal axis.
Figure 6A:
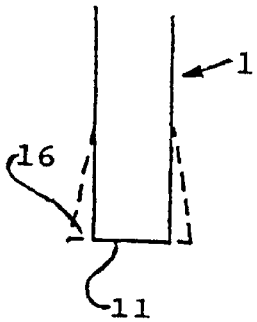
FIG. 6*a* shows a shape of the pointed end of the lance.

As will be evident from the above, the lances 1 can be in the form of simple tubes, but these tubes can advantageously be subjected to a certain processing. Thus, the point 11 on the tube or lance 1 having the exit aperture 15 can be pressed flat in the manner shown in FIG. 5, and this compression of the point 11 on the lance 1 can be carried out to an extent so as to leave an exit slit 15 serving as an exit aperture. It is also possible, however, to compress the tube completely so as to close it as shown in FIGS. 5*a* and 5*b*. When the tube has been compressed, the point 11 will have a shape as shown in broken lines on FIGS. 6 and 6*a*, the point 11 initially been given a shape of a spatula as indicated in broken lines. After this, the protruding part 16 of the point 11 can be cut or ground away, so that the point 11 becomes shaped like a chisel as shown in FIG. 6*a* or like a needle as shown in FIG. 6.

If the lance 1 has been fully compressed at the outer end of the point 11, a grinding-away operation will produce an exit aperture 15 on both sides of the point 11 in the manner shown in FIG. 5*a*. Alternatively, the lance 1 can be provided with drilled holes 15 at its point in the manner shown in FIG. 5*b*. The point 11 on the lance 1 and the exit apertures 15 can be given numerous shapes, chosen so as to be most expedient with regard to processing and the possibility of penetrating into the moulds without the exit apertures 15 being blocked.

Further, the lance can be provided with a collar 13 used for introducing and removing the lance 1 and/or to lie in sealing abutment against the lower side of the slot 2 when the lance is supplied with pressure from a pressure chamber 3. At the end opposite to the end with the point 11, the lance 1 may simply be cut off like a tube serving as the supply end 10, or it can be cut at an angle or provided with slots or holes, all depending on what is most expedient with regard to introducing the lance between the lips 20 in the slot 2 and the pressing-down element 5.

FIGS. 2 and 3 show partial sections of the pressure-supply system, showing how the lips 20 in the slot 12 fit sealingly about the lance 1 at the supply end 10. The lips 20 are made from elastically resilient material, that can be more or less compact, and the material can e.g. be foam rubber, or the lips 20 can be in the form of flexible tubes, to which pressure is applied from an external source, so that the pressure makes them press towards each other along the parting surface 21 or against a lance 1 in the manner shown in FIGS. 2 and 3.

As shown in FIG. 1, the pressure-supply system is in the form of a pressure chamber 3 having a slot 2 extending substantially as a straight line, but at the entry end (to the left in FIG. 1) extending obliquely upward opposite to the direction of advancement of the mould parts as shown with the arrow 31. As viewed in planes at right angles with the plane of FIG. 1, the slot 2 is substantially in the shape of a slot about a straight line, so that the lances can slide in gradually at the entry end of the slot 2 and with their supply ends 10 come into the pressure chamber 3 and slide along the slot 2 without being subjected to transverse forces. The pressure-chamber unit proper comprising the pressure chamber 3, the pressure-chamber enclosure 9, the slot 2 and the pressing-down element 5 can be constructed as an independent adjustable unit, capable of being adjusted depending on the path and the height, through which the lances 1 run, and the height they are to be pressed down to. If so, the pressing-down element 5 can also be made adjustable, so that it is not necessary to adjust the entire unit, but merely to adjust the height of the pressing-down element 5, if the pressing-down depth for the lances is to be altered. The pressing-down element 5 can, of course, be constructed in a different manner; thus, it can be placed outside of the pressure-chamber 3 and be adapted to co-operate with e.g. a collar of a similar kind to the collar 13 on the lances 1 and placed below the latter. It can also be movable. The pressure-supply unit itself can be fed from a stationary pressure source 4, the latter being connected to the pressure chamber 3 through a flexible tube 22. Thus, it is possible to achieve a high degree of adaptability with the pressure-supply system described, and the latter can in a simple manner be post-installed in existing plants.

Figure 4A:
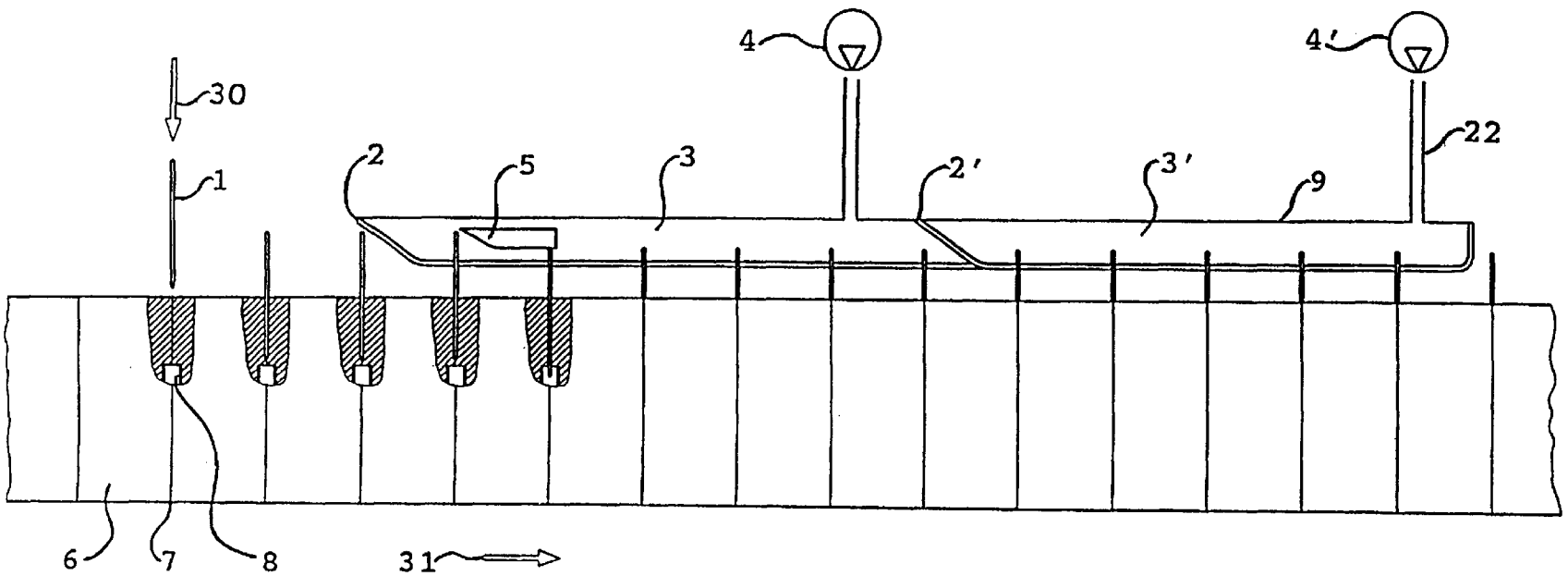
FIGS. 4*a* and 4*b* show pressure-supply systems with which two different pressures can be provided in an advantageous manner.

FIG. 4*a* shows a pressure-supply system that is subdivided into two pressure chambers 3 and 3'. This division can be advantageous when it is desirable to distribute the pressure losses on more than one pressure source along the pressure-supply section, or when it is desirable to increase the pressure along the pressure-supply section, the latter being possible by supplying one pressure from the pressure source 4 and a higher pressure from the pressure source 4'. Further, the division into different pressure chambers can also be advantageous when the plant is used for varying production, so that when the full length of the pressure-section is not needed, i.e. that the castings have solidified upstream of the last pressure-chamber section, the supply of pressure to the latter can be cut off.

Figure 4B:
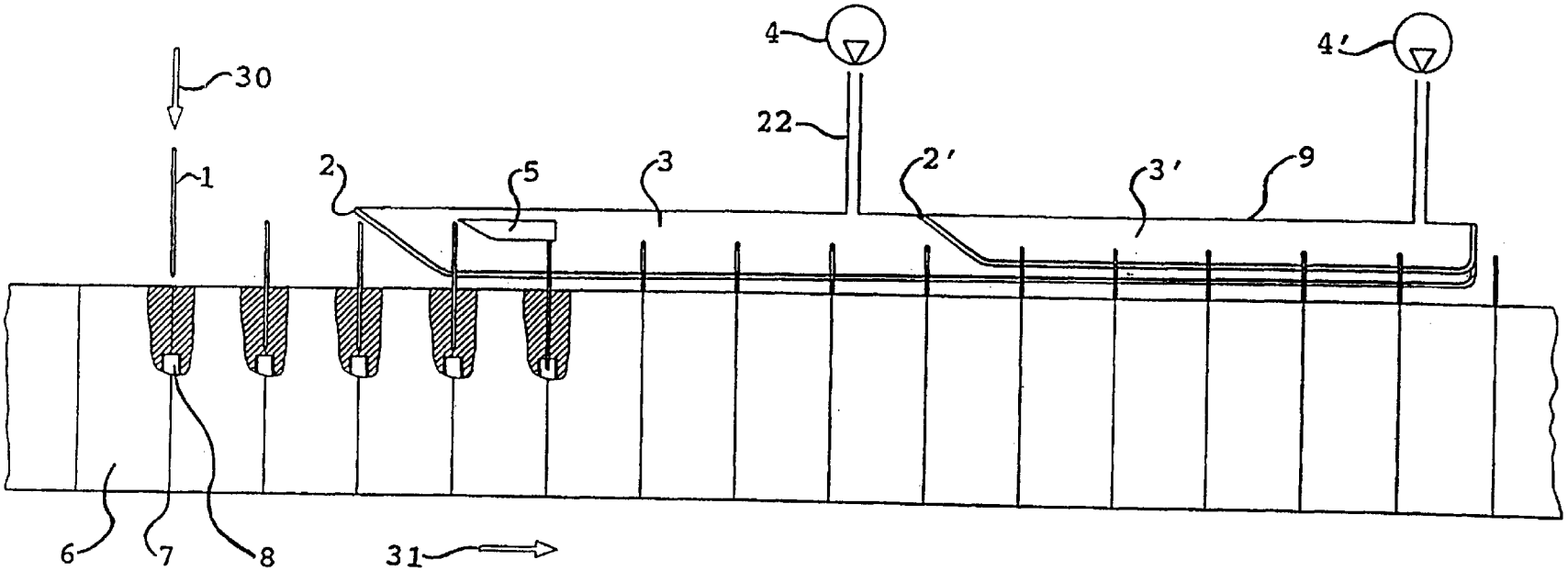

FIG. 4*b* shows an advantageous embodiment of the division in more than one pressure-chamber, when a high pressure is to be supplied by means of a succeeding pressure chamber, the latter being built into a preceding pressure chamber, so that the pressure difference across the lips 20 from one pressure chamber 3' to another pressure chamber 3 becomes less than in the case of the atmospheric pressure having reigned outside of the lips 20 at the pressure chamber 3'. With this arrangement, it is possible to use a pressure chamber 3' at a higher pressure than was otherwise possible and/or with reduced losses.

All in all, the invention provides a possibility of using pressure-supply conduits in the form of simple lances that can be provided in a simple and low-cost manner by uncomplicated processing of standard tubes or in some other way. A particularly advantageous possibility consists in making the lances of the same material as is used for casting in the mould cavities concerned. In this manner it is achieved, partly that contamination of the castings with "foreign" material is avoided, partly that the lances after extraction, deburring and removal of risers etc. from the castings can form part of the total quantity of metal being returned for renewed melting—otherwise, a meticulous and hence labour-demanding sorting would be needed.

Moreover, it is possible to use relatively advanced pressure-control arrangements for the pressure sources 4, as the latter can simply be chosen in the form of standard pressure sources, e.g. compressors, with the requisite control arrangements. Further, the replacement of parts subject to wear, i.e. the lips 20, can be carried out in a simple manner, when the pressure-chamber enclosure 9 is made to be open about the slot 2, so that the lips 20 can merely be removed from holding grooves and be replaced with new lips 20, the latter e.g. being in the form of an elastically resilient ribbon being cut in the requisite length for the slot 2. The pressure-supply system is extremely adaptable when the pressure chamber 3 or the pressure chambers 3, 3' is/are made as a unit capable of being moved about according to need, and is connected to one or a number of pressure sources 4, 4' via a pressure-supply conduit 22, e.g. in the form of a flexible tube, this making it possible to move and adjust the pressure-supply unit to the path being followed on the outside of the mould part 6 by pressure-supply conduits to the after-feeding reservoir, and this makes it possible to adapt the system to varying moulds, in which the pressure-supply conduits 1 in the form of lances can follow different paths. Further, it is possible in a simple manner to adapt the lances to the moulds being used in each case, the manufacture of the lances 1 for the system being a simple matter. In addition to this, it is possible to use existing pressure sources or standard pressure sources 4, the latter being connected to the pressure-supply unit in a conventional manner.

What is claimed is:

1. A method of active after-feeding castings in casting moulds with at least one after-feeding reservoir, each after-feeding reservoir communicating with at least one mould cavity, a gas pressure being applied and maintained on a molten metal in at least one after-feeding reservoir, until the metal in the at least one mould cavity has solidified, said method comprising the steps of:

a) initially inserting at least one gas pressure-supply lance member into the mould such that a distal end of the lance member is located in the mould, and b) supplying a gas pressure to the distal end of the at least one pressure-supply lance member and further inserting the distal end of the at least one gas pressure-supply lance member into the after-feeding reservoir such that the gas pressure is supplied into the at least one after-feeding reservoir.

2. A method according to claim 1, wherein a barrier is provided between the after-feeding reservoir and the pressure-supply lance member, and further including the step of causing said at least one pressure-supply lance member being supplied with pressure to penetrate said barrier so as to communicate with the after-feeding reservoir.

3. A method according to claim 1, wherein the pressure-supply lance member (a) includes a pressure-supply proximal end, (b) is in the form of a tube connected substantially rigidly to a pressure-exit aperture at the distal end, and wherein said further inserting step includes the step of applying a force to the pressure-supply lance member at or close to the proximal end thereof.

4. A method according to claim 1, wherein a successive pouring of a number of moulds causes the moulds to be advanced along a path of movement in a mould string, and wherein, during the advancement of each mould along said path of movement, said supplying step includes the steps of causing the proximal end of said pressure-supply lance member to engage a pressure-supply system by pressing said proximal end in between elastically resilient lips in a slot so as to make said proximal end communicate with a pressure chamber behind said lips and said slot, in which pressure chamber a gas pressure above atmospheric pressure is provided.

5. A method according to claim 4, wherein said further inserting step occurs when said proximal end of said pressure-supply lance member is in the pressure chamber behind the lips and the slot, with the proximal end being pressed distally towards the lips without leaving the pressure chamber to such a degree that the distal end of said pressure-supply lance member comprising the exit aperture is made to penetrate the mould material into the after-feeding reservoir, so that said pressure-supply lance member provides pressure communication between the pressure chamber and the reservoir via said proximal end and the exit aperture of the pressure-supply lance member.

6. A method according to claim 4, wherein the pressure-supply system includes more than one pressure section, and wherein said supplying step includes the step of passing said proximal end into at least one second pressure chamber, such that the second pressure chamber communicates with the after-feeding reservoir through said proximal end.

7. A method according to claim 3, wherein the further inserting force and a succeeding extraction force is provided via a collar located on said pressure-supply lance member at a distance from said proximal end, and wherein said applying step includes forcing the collar into abutment with the mould to provide further sealing between the mould and the pressure-supply lance member.

8. A method according to claim 6, wherein the pressure-supply system includes the first-mentioned slot in the first-mentioned pressure chamber and a second slot into the second pressure chamber, the first and second slots being provided in a longitudinal direction parallel to the direction of advancement along which the proximal end of the pressure-supply lance member travels, and in which the first slot at an entry end thereof lies at a first distance from the mould string, and the first and second slots as from said entry end extend obliquely in the downward direction to a second, shorter distance from the mould string.

9. A method according to claim 1, wherein the casting in moulds have one of horizontal parting surfaces, vertical parting surfaces, or parting surfaces making arbitrary angles with the horizontal.

10. A pressure-supply system for carrying out an active after-feeding castings in moving casting moulds with at least one after-feeding reservoir, each after-feeding reservoir communicating with at least one mould cavity, a gas pressure being applied and maintained on a molten metal in at least one after-feeding reservoir, until the metal in the at least one mould cavity has solidified, said pressure supply system comprising:

at least one pressure chamber adapted to be supplied with pressure from at least one pressure source, said pressure chamber being provided with a slot closed by elastically resilient lips pressing from each respective side of said slot into mutually sealing abutment about a parting surface, and a tubular lance having a rearmost end and a forwardmost end, said lance further having an apertured inlet end at the rearmost end and at least one exit aperture at the forwardmost most end, said lance being adapted to be inserted into a casting mould after forming thereof and to move along with the casting mould so as to make said at least one exit aperture communicate with the after-feeding reservoir of said casting mould, and wherein said slot and lips are shaped and dimensioned to receive the proximal end such that said proximal end moves in a longitudinal direction of the slot and hence in a direction of advancement of said mould, during which advancement said lips embracing said proximal end in a substantially air-tight manner at said parting surfaces.

11. A pressure-supply system according to claim 10, wherein said lance is pointed at the forwardmost end, said forwardmost end comprising the at least one exit aperture, the pointed forwardmost end at least being one of chisel-shaped in one plane or needle-shaped in two planes.

12. A pressure-supply system according to claim 11, wherein the pointed shape is provided by compressing the forwardmost end in one plane and subsequently grinding the sides in this one plane.

13. A pressure-supply system according to claim 10, wherein said lance is provided with a protruding collar element, said collar element being placed at a distance from this rearmost end.

14. A pressure-supply system according to claim 10, wherein said lance is provided with one of a coating or blackening, at least at the end closest to the at least one exit aperture.

15. A pressure-supply system according to claim 10, wherein said slot from an upstream end extends firstly downwardly inclined toward the mould and then substantially parallel to the direction of advancement of the mould.

16. A pressure-supply system according to claim 10, wherein there are a number of pressure chambers provided in succession, and wherein said pressure chambers are mutually separated by one or a number of said slots.

17. A pressure-supply system according to claim 16, wherein in a succeeding said pressure chamber, a succeeding said slot extends above a preceding said slot of an upstream preceding said pressure chamber, so that said succeeding said slot extends above said preceding said slot and one of inwardly against said preceding pressure chamber or within both said preceding and succeeding pressure chambers.

18. A pressure-supply system according to claim 10, wherein said lips are made from an elastically resilient material.

19. A pressure-supply system according to claim 10, wherein said lips are flexible tubes adapted to be pressurized by an external pressure source.

* * * * *